United States Patent [19]

Nitzsche

[11] Patent Number: 4,890,349

[45] Date of Patent: Jan. 2, 1990

[54] TOOTH CARE ATRICLE SUCH AS A TOOTHBRUSH WITH REPLACEABLE INSERT

[76] Inventor: Klaus Nitzsche, De-La-Fosse-Weg 1a, 6100, Darmstadt, Fed. Rep. of Germany

[21] Appl. No.: 209,568

[22] Filed: Jun. 21, 1988

[30] Foreign Application Priority Data

Jul. 25, 1987 [DE] Fed. Rep. of Germany ..... 3724640

[51] Int. Cl.[4] ..... A46B 9/04

[52] U.S. Cl. ..... 15/167.1; 15/176.5

[58] Field of Search ..... 15/167.1, 167.2, 167.3, 15/176.1, 176.2, 176.3, 176.4, 176.5, 176.6, 194, 202, 145, 110; 132/308, 309, 310, 311; 401/118, 268, 123, 124, 125, 290; D 4/104, 105, 106, 107, 108, 109, 110, 111, 112, 113; 128/62 A

[56] References Cited

U.S. PATENT DOCUMENTS

| | | | |
|---|---|---|---|
| 1,717,125 | 6/1929 | Spitz | 15/176.4 |
| 2,476,201 | 7/1949 | Ligoure | 15/110 X |
| 2,545,814 | 3/1951 | Kempster | 15/167.1 X |
| 4,411,041 | 10/1983 | Braga | 15/167.1 |
| 4,543,679 | 10/1985 | Rosofsky et al. | 15/167.1 X |
| 4,683,604 | 8/1987 | Rueb | 15/145 X |

FOREIGN PATENT DOCUMENTS

| | | | |
|---|---|---|---|
| 3038895 | 8/1982 | Fed. Rep. of Germany . | |
| 37268 | 11/1930 | France | 15/167.1 |
| 2559656 | 8/1985 | France | 15/176.1 |
| 306712 | 2/1929 | United Kingdom | 15/176.5 |

*Primary Examiner*—Philip R. Coe
*Assistant Examiner*—Scott J. Haugland
*Attorney, Agent, or Firm*—Burns, Doane, Swecker & Mathis

[57] ABSTRACT

A toothbrush comprises a handle with a socket at one end. A brush-carrying insert includes a tongue removably mounted in the socket. A brush protrudes forwardly from the tongue. Adjacent a location where the brush is joined to the tongue, a laterally outwardly projecting sealing lip is formed on the insert, which lip bears elastically against a front rim of the socket. The tongue carries locking ledges of different heights which fit into a groove of the socket. The tongue may include a pressure projection which extends through a hole in the socket rear wall to present an exposed face which can be pushed against to expel the insert. Alternatively, the socket rear wall can be elastically displaceable for expelling the insert.

6 Claims, 2 Drawing Sheets

TOOTH CARE ATRICLE SUCH AS A TOOTHBRUSH WITH REPLACEABLE INSERT

BACKGROUND AND OBJECTS OF THE INVENTION

The invention concerns a tooth care element such as a toothbrush with a replaceable insert.

Toothbrushes with replaceable brush inserts have been previously proposed. With such toothbrushes it is possible to exchange different brush inserts having bristles of different hardness, for example, while retaining the handle piece. The head part of the handle piece is designed to effect a positive and/or frictional connection with the brush insert. For example, the head part of the handle piece may have a dove-tail or tongue-shaped insertion part which is inserted into an appropriately shaped recess of the brush insert to clamp or lock-in the insert. It is common to these configurations that the production of the brush insert is relatively complicated due to the required presence of the insertion opening.

In a known toothbrush of the afore-mentioned generic type (disclosed in German No. OS-30 38 895), a mounting part of the brush insert is placed into a socket of the elongated handle. Radially projecting ledges on the mounting part are locked into corresponding elongated recesses in the inner wall of the socket. A projection located on the rear side of the mounting part extends through an elongated opening in the rear wall of the socket. By depressing this pressure projection the insert may be released from the socket.

In this known toothbrush, a gap existing between the tongue of the insert and a front rim of the socket is open, whereby during the use of the toothbrush, substances such as food particles, toothpaste residues, and saliva may enter the gap from the bristle-side thereof and cannot be removed even by a thorough cleaning of the toothbrush unless the insert is removed. The presence of such substances is undesirable for hygienic reasons. Eventually, the forces applied during use of the toothbrush may produce a temporary widening of the gap, thereby generating a pumping action which facilitates the penetration of impurities.

It is, therefore, an object of the invention to provide a toothbrush of the afore-mentioned type in which the penetration of impurities from the bristle side is prevented, even despite the application of forces during use.

SUMMARY OF THE INVENTION

This object is attained according to the invention by providing the insert with a tongue having a laterally outwardly projecting flange forming an elastic sealing lip against a front rim of the handle socket.

The sealing lip eliminates any gap between the brush insert and the socket rim into which impurities could penetrate. The forces generated in use, i.e., essentially compressive forces in the direction of the bristles, merely serve to push the sealing lip more tightly against the rim, so as to more intensely prevent the generation of a gap.

To press the sealing lip as effectively as possible against the socket rim, and thus to obtain a strong sealing effect, the sealing lip can be held against the rim by the locking connection between the brush insert and the socket, whereby the sealing lip is elastic prestressed against the rim. This elastic prestressing prevents the formation of a gap between the brush insert and the rim even when the pressure is relieved and the rim is deformed laterally.

The tongue is preferably provided, along two side surfaces and one end surface thereof, with laterally projecting locking ledges, and the socket comprises a groove located at a distance from, and parallel to, the rim. The groove forms an inner undercut in the socket to receive the locking ledges.

The portion of the socket located between the groove and rim forms a circumferential bead which rigidifies the socket even if the rim has only a relatively thin wall thickness. The groove may have a configuration such that the penetration of the locking ledges thereinto generates the prestressing desired, whereby the sealing lip is pressed against the socket rim.

In contrast to the known state of the art, the rear wall of the socket is preferably solid except for an opening for receiving a pressure projection of the insert. This essentially closed rear wall provides the head part with an increased rigidity, even in a thin-walled configuration.

Alteratively, the socket rear wall may be completely solid and yet elastically deformable to the extent that the brush insert may be pressed out of the socket by the deformation of the socket rear wall. In this manner, the presence of an opening in the rear wall of the socket through which impurities may enter is avoided.

BRIEF DESCRIPTION OF THE DRAWINGS

The objects and advantages of the invention will become apparent from the following detailed description of preferred embodiments thereof in connection with the accompanying drawings in which like numerals designate like elements, and in which.

DETAILED DESCRIPTION OF PREFERRED EMBODIMENTS OF THE INVENTION

Figure 1:
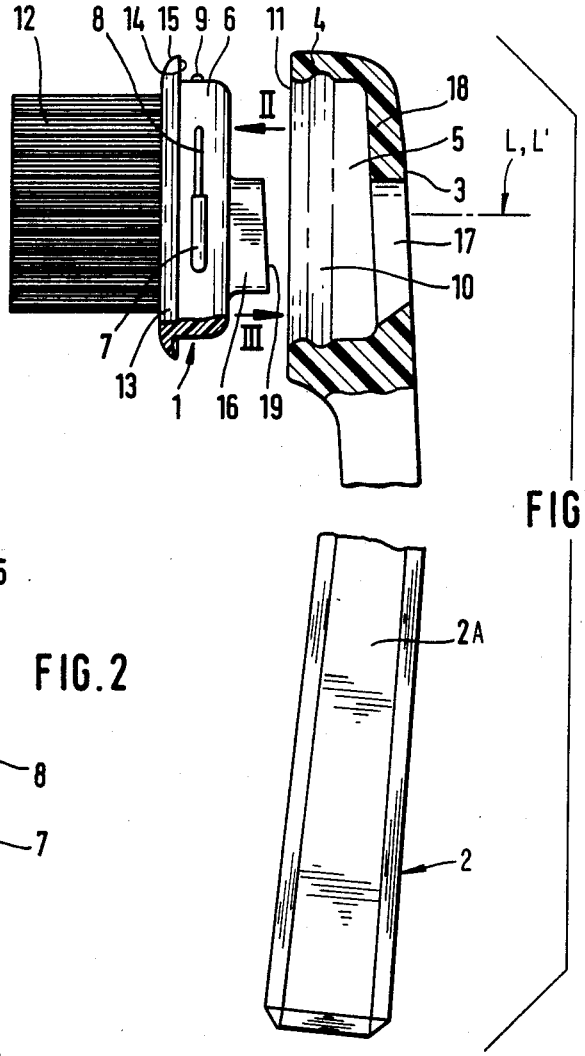
FIG. 1 is an exploded side elevational view of a handle and brush insert, with portions of the handle and insert broken away.

A toothbrush shown in FIG. 1 comprises a removable brush insert 1 and a handle 2 having a gripping part 2A and a head part 3. As seen in FIG. 1, the gripping part 2A is slightly angled relative to the head part 3, and is gradually thickened toward its end opposite the head part so that the gripping part 2A fits comfortably into the hand of the user. The head part 3 comprises an elongated (non-circular) socket 4 which includes an opening 5, into which fits an elongated mounting tongue 6 of the brush insert 1. The tongue comprises part of a body portion of the insert. The tongue and socket define longitudinal center axes L, L′ which are aligned when the insert is installed in the handle.

The tongue includes two parallel side walls and two shorter parallel end walls. Each of the side walls carries a pair of holding ledges 7, 8 projecting laterally outwardly relative to the axis L. One of the end walls carries a holding ledge 9 which also projects laterally outwardly. The ledges 7, 8, 9 are adapted to be received in a circumferential groove 10 formed around the inner wall of the socket opening 5. The groove 10 lies in a plane which is parallel to, and spaced from, a front rim 11 of the frame 4.

The brush insert 1 carries a tooth care element, such as for example bristles 12, gum massager, cleaning hook, etc.

Figure 4:
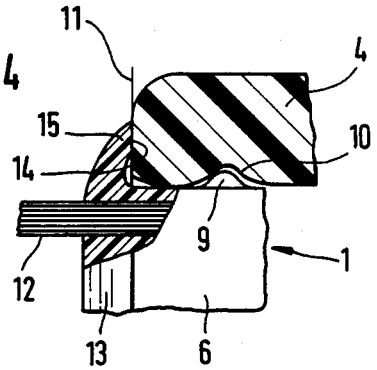
FIG. 4 is an enlarged fragmentary view, partially broken away, of the interface between the brush insert and the socket.

Projecting laterally from an end of the tongue disposed adjacent the bristles is a flange 13 which extends circumferentially around the tongue. The flange defines an elastic sealing lip 15, a face 14 of which is adapted to rest sealingly against the front rim 11 of the socket 4 as shown in FIG. 4.

On its rear side (facing away from the bristles 12) the tongue 6 carries a pressure projection 16 located eccentrically relative to the axis L. The projection 16 is adapted to protrude through a correspondingly shaped opening 17 in a rear wall 18 of the head part 3. By applying pressure to a rear surface 19 of the pressure projection 16 (after the insert has been installed), the brush insert 1 may be released from its locked connection with the head part 3. In this way, the insert can be replaced by another insert.

Figure 2:
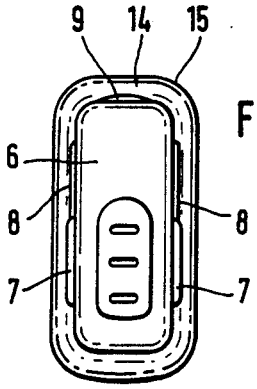
FIG. 2 is a rear view of the brush insert viewed in the direction of the arrow II in FIG. 1.
Figure 3:
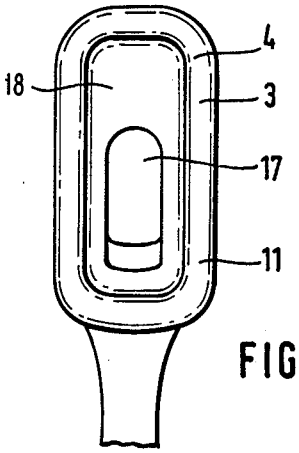
FIG. 3 is a front view of a socket portion of the handle viewed in the direction III in FIG. 1.

As can be seen in FIGS. 1 and 2, the locking ledge 9 is provided on the end wall which is farthest from the pressure projection 16. The locking ledges 7 located adjacent to the pressure projection 16 are taller than the other shorter locking ledges 8, 9, i.e., the ledges 7 protrude laterally farther from the holder part 6 than the ledges 8, 9. When pressure is applied to the rear surface 19 of the pressure projection 16, initially the taller locking ledges 7 are pushed from the groove 10, whereupon the insert is held only loosely by the shorter ledges 8, 9 which enables the insert to then be easily removed.

When the locking ledges 7, 8 and 9 are locked into the circumferential groove 10, the sealing lip 15 is pressed by an elastic prestress against the front rim 11 of the socket 4. The sealing lip 15 thus seals the holder opening 5 outwardly against the bristle side. A seal on the opposite side of the insert is obtained because the pressure projection 16 fits sealingly into the opening 17.

Figure 5:
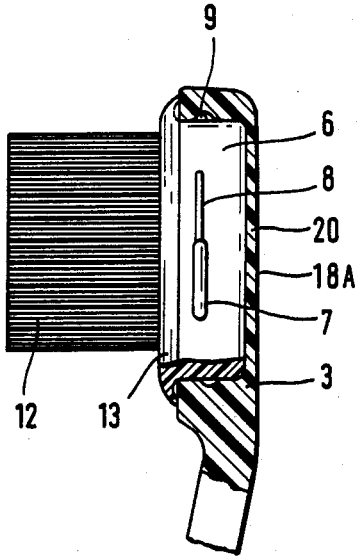
FIG. 5 is a side elevational view, partially broken away, of a modified embodiment of the invention.
Figure 6:
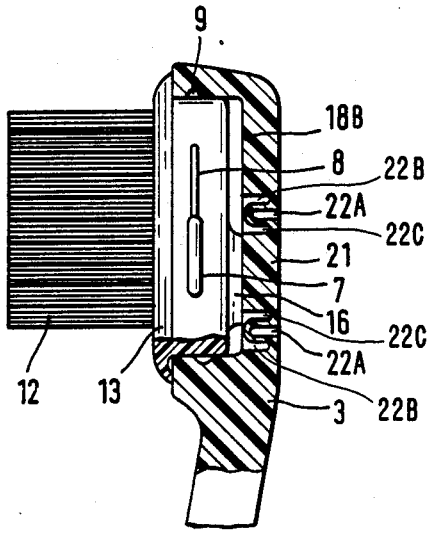
FIG. 6 is a view similar to FIG. 5 of a further modification.

Modified sealing arrangements are shown in FIGS. 5 and 6, respectively. For example, as depicted in FIG. 5, the rear wall 18A of the head part 3 is completely closed; that rear wall is, however, thin-walled to the extent that it is easily deformed when pressed manually on its rear side. Thus, pressure may be manually applied to the rear side 20 of the tongue 6 (or to the top side 19 of a pressure projection 16 provided on the tongue) in order to release the brush insert 1 from its locked connection in the head part 3.

Instead of having a thin-walled configuration, the rear wall 18B may be thick but designed to be deformable against the front surface of the tongue 6 only in a region located eccentrically relative to the axis L. As depicted in FIG. 6, the rear wall 18B is completely closed and includes an elastically displaceable section 21 which can be elastically flexed toward the pressure projection 16. The displaceable section 21 is defined by an endless weakened zone such as that comprising a rectangular recess 22A formed in the rear surface of the rear wall 18B, and a pair of rectangular, concentric recesses 22B, 22C formed in the front surface of the rear wall 18B. Those recesses 22A, 22B, and 22C form a bellows-like connection between the displaceable section 21 and the remainder of the rear wall 18B. The displaceable section is aligned with a rear surface of the pressure protrusion 16 so that when pressure is applied to the rear surface of the displaceable section 21, the latter is elastically displaced forwardly to eject the insert.

The tongue and handle are preferably formed of plastic to provide ledges 7, 8, 9 with sufficient flexibility to be snapped into and from the groove 10.

It will be appreciated that the present invention provides a tooth care article having a removable insert which effectively prevents the entry of impurities between the insert and handle by means of a simple and inexpensive construction. Furthermore, the ejection of the insert is provided in a manner which avoids the need for an opening in the rear wall of the socket.

Although the present invention has been described in connection with preferred embodiments thereof, it will be appreciated by those skilled in the art that modifications, additions, substitutions and deletions not specifically described may be made without departing from the spirit and scope of the invention as defined in the appended claims.

What is claimed is:

1. A tooth care article comprising:

a handle including a manual gripping portion at one end and a forwardly opening socket at the other end, said socket terminating in a forwardly facing rim, and a brush insert removably mounted in said socket, said insert comprising a body which includes a rearwardly extending tongue removably mounted in said socket, a tooth care member extending forwardly of said body, and a sealing flange projecting laterally outwardly adjacent a region where said body and tooth care member are joined, said sealing flange elastically abutting said socket rim, said socket including a rear wall having an opening extending therethrough and arranged eccentrically relative to a longitudinal axis of said socket, said tongue including a pressure projection extending into said opening, whereby a rear surface of said pressure projection is exposed to manual pressure, said socket including a locking groove formed in an inner surface thereof, said tongue carrying laterally projecting ledges elastically received in said groove, said tongue including two long side surfaces and two short end surfaces, said ledges projecting from both side surfaces and one end surface, each of said ledges which project from said side surfaces including a tall ledge portion and a short ledge portion, said tall ledge portions disposed adjacent said pressure protrusion and projecting from said tongue farther than said short ledge portions, said ledge on said end surface comprising a short ledge.

2. A tooth care article according to claim 1, wherein said sealing flange is elastically prestressed against said rim when said tongue is held in said socket.

3. A tooth care article according to claim 1, wherein said pressure projection fits sealingly into said opening.

4. A tooth care article according to claim 1, wherein said tooth care member comprises a bristle brush.

5. A tooth care article comprising:

a handle including a manual gripping portion at one end and a forwardly opening socket at the other end, said socket terminating in a forwardly facing rim, and a brush insert removably mounted in said socket, said insert comprising a body which includes a rearwardly extending tongue removably mounted in said socket, a tooth care member extending forwardly of said body, and a sealing flange projecting laterally outwardly adjacent a region where said body and tooth care member are joined, said sealing flange elastically abutting said socket rim, said socket including a solid rear wall only a portion of which is elastically flexible toward said tongue for forcing said tongue from said socket, said portion of said rear wall formed by a weakened bellows-like area of said rear wall, said weakened area being of endless configuration.

6. A tooth care article according to claim 5, wherein said tooth care member comprises a bristle brush.

* * * * *